United States Patent [19]

Miller

[11] Patent Number: 4,538,586

[45] Date of Patent: Sep. 3, 1985

[54] CAPACITIVE DISCHARGE IGNITION WITH LONG SPARK DURATION

[75] Inventor: Thomas P. Miller, Charlotte, N.C.

[73] Assignee: Textron, Inc., Providence, R.I.

[21] Appl. No.: 563,864

[22] Filed: Dec. 21, 1983

[51] Int. Cl.[3] ..... F02P 1/00

[52] U.S. Cl. ..... 123/620; 123/599; 123/149 R

[58] Field of Search ..... 123/599, 602, 620, 149 R, 123/149 D

[56] References Cited

U.S. PATENT DOCUMENTS

| | | | |
|---|---|---|---|
| Re. 27,477 | 9/1972 | Piteo | 123/599 |
| 3,358,665 | 12/1967 | Carmichael et al. | 123/599 |
| 3,461,851 | 8/1969 | Stephens | 123/599 |
| 3,490,426 | 1/1970 | Farr | 123/599 |
| 3,517,655 | 6/1970 | Jaulmes | 123/599 |
| 3,598,098 | 8/1971 | Sohner et al. | 123/599 |
| 3,667,441 | 6/1972 | Cavil | 123/599 |
| 3,720,194 | 3/1973 | Mallory, Jr. | 123/599 |
| 3,747,649 | 7/1973 | Densow et al. | 123/599 |
| 3,788,293 | 1/1974 | Anderson | 123/620 |
| 3,828,754 | 8/1974 | Carlsson | 123/599 |
| 3,835,830 | 9/1974 | Shepherd | 123/599 |
| 3,955,550 | 5/1976 | Carlsson | 123/599 |
| 3,980,922 | 9/1976 | Katsumata | 123/599 |
| 4,056,088 | 11/1977 | Carmichael | 123/599 |
| 4,074,669 | 2/1978 | Cavil et al. | 123/599 |
| 4,120,277 | 10/1978 | Ehlen | 123/599 |
| 4,213,436 | 7/1980 | Burson | 123/599 |

*Primary Examiner*—Ronald B. Cox

*Attorney, Agent, or Firm*—Cushman, Darby and Cushman

[57] ABSTRACT

A capacitive discharge ignition system wherein the transformer secondary is responsive to changing magnetic flux such that supplemental voltage, of magnitude in excess of the spark sustaining voltage for a relatively long time period, is induced in the secondary coil in timed relation to high voltage damped oscillatory voltages induced by capacitive discharge. The magnetically induced voltage combines with the discharge induced voltage to provide at least one pulse in excess of the spark ionization potential to initiate a spark, and, in cooperation with the secondary coil inductance, thereafter sustains the spark for the duration of the time period despite the remainder of the discharge induced voltages.

10 Claims, 5 Drawing Figures

CORE LEGS ELONGATED
FOR CIRCUIT CLARITY

@ 7000 PM
SECONDARY OUTPUT DUE ONLY TO CAP DISCHARGE
20.0
18.0
16.0
14.0
12.0
10.0
8.0
6.0
4.0
2.0
-2.0
-4.0
-6.0
-8.0
-10.0
-12.0
-14.0
-16.0
-18.0
-20.0
-22.0
-24.0
2.1
2.2
2.3 m SEC.
IONIZATION POTENTIAL
IONIZATION POTENTIAL
302
303
304
305
306
307
308
309
310
311
312

IONIZATION POTENTIAL
SUSTAINING POTENTIAL
IONIZATION POTENTIAL
400 SECONDARY INDUCED O.C. VOLTAGE
TRIGGER @7000 RPM
TRIGGER ZONE
-16.0
-14.0
-12.0
-10.0
-8.0
-6.0
-4.0
-2.0
0
-2.0
-4.0
-6.0
-8.0
-10.0
-12.00
2.1
2.2
2.3
2.4
2.5
2.6
2.7
2.8
2.9 m SEC.

CAPACITIVE DISCHARGE IGNITION WITH LONG SPARK DURATION

BACKGROUND OF THE INVENTION

The present invention is related to capacitive discharge ignitions, and, in particular, to capacitive discharge ignitions which provide a spark of long duration.

Capacitive discharge ignitions (CDIs) are, in general, well-known. Examples of capacitive discharge ignitions are described in the following U.S. Pat. No. 4,074,669, issued to Cavil, Feb. 1978; U.S. Pat. No. 4,056,088, issued to Carmichael, Nov. 1977; U.S. Pat. No. 4,213,436, issued to Burson, July 1980; U.S. Pat. No. 3,955,550, issued to Carlsson, May 1976; U.S. Pat. No. 3,828,754, issued to Carlsson, Aug. 1974; U.S. Pat. No. 3,358,665, issued to Carmichael et al, Dec. 1967; U.S. Pat. No. 3,667,441, issued to Cavil, June 1972; U.S. Pat. No. 3,747,649, issued to Densow et al, July 1973; U.S. Pat. No. 3,490,426, issued to Farr, Jan. 1970; U.S. Pat. No. 3,517,655, issued to Jaulmes, June 1970; U.S. Pat. No. 3,720,194, issued to Mallory, Jr., Mar. 1973; U.S. Pat. No. Re. 27,477, issued to Piteo, Sept. 1972; U.S. Pat No. 3,835,830, issued to Shepherd, Sept. 1974; U.S. Pat. No. 3,598,098, issued to Sohner, Aug. 1971; and U.S. Pat. No. 3,461,851, issued to Stephens, Aug. 1969.

In general, such capacitive discharge ignition systems include a charge storage mechanism, such as a capacitor, a step-up transformer with the secondary thereof connected to a spark ignition device, e.g., spark plug, and a mechanism for controllably charging the capacitor and discharging the capacitor through the primary coil of the transformer in timed relation with the cooperating engine operation. Typically, a charge coil magnetically interacts with a rotor or flywheel rotated in synchronism with motor operation. A switching device, such as a silicon-controlled rectifier (SCR), is provided to controllably complete a discharge path from the capacitor through the transformer primary coil. The SCR, in turn, is triggered by a pulse generated in timed relation to the motor operation. The trigger pulse is typically generated either by interaction of a separate inductive trigger coil with the rotor, or by reversal of polarity of the voltage induced in the charging coil or similar use of the primary coil.

Various of the CDI systems utilize a separate triggering coil magnetically isolated from the charge coil. See, e.g., U.S. Pat. No. 3,598,098 to Sohner et al. Other CDI systems, such as those described in the aforesaid U.S. Pat. No. 3,667,441 to Cavil, U.S. Pat. No. 3,747,649 to Densow et al, and U.S. Pat. No. 4,074,669 to Cavil et al, employ separate trigger and charge coils (e.g., respective portions of a center tapped coil), which are disposed on the same magnetic core as the charge coil.

The discharge of the capacitor through the transformer primary coil induces a high voltage signal in the transformer secondary, which, if of sufficiently high magnitude, initiates a spark across the spark ignition device. More specifically, the voltage applied across a spark ignition device must be greater or equal to a predetermined characteristic "spark ionization potential" (voltage) in order to initiate the spark. Such ionization potentials are typically on the order of 10,000 volts (10 Kv). However, once the spark has been initiated, it is only necessary to maintain the gap voltage at a substantially lesser characteristic sustaining voltage, on the order of 500 volts, in order to sustain the spark.

It is desirable that a small CDI system generate sparks which manifest both high energy and long duration in order to facilitate starting the cooperating engine. Known induction magnetos provide such features, but tend to be more expensive and less reliable than CDI magnetos. The prior art CDI magnetos typically do not provide high energy and long duration sparks. In this regard, various of the prior art CDI systems employ multiple sparks generated in response to a damped oscillatory discharge of the capacitor through the transformer primary coil. See, e.g., the aforementioned U.S. Pat. No. 3,490,426 to Farr. More specifically, in multiple spark systems, the capacitor is initially charged with a first polarity, then discharged through the SCR. Discharging the capacitor through the SCR, however, recharges the capacitor with the opposite polarity. The capacitor, thus oppositely charged, is then discharged, and recharged to the initial polarity through a diode. Each discharge of the capacitor through the transformer primary coil induces a voltage in the transformer secondary, which, if of a sufficiently high magnitude, effects generation of a spark. The duration of the individual sparks, however, is only that of the discharge of the capacitor and thus extremely short in view of the low resistance of the discharge path.

It is also, in general, known to dispose the charge coil and transformer windings on a common magnetic core. In this regard, reference is made to the aforementioned U.S. Pat. No. 3,589,098 to Sohner et al and U.S. Pat. No. 4,056,088 to Carmichael. Carmichael teaches that by providing the ignition transformer coils on the same magnetic core as the charge/trigger winding (in systems not using a separate trigger coil), the primary winding of the ignition coil is energized not only by discharge of the capacitor, but also simultaneously by the magnetic field used to induce a charging current in the charge/trigger winding, and thus increased power can be supplied to the spark plug. However, such prior art systems have not provided an induced voltage in the transformer secondary of sufficiently high magnitude and in proper timed relation with the capacitive discharge to provide a sustaining voltage to the spark plug.

CDI systems have been proposed which provide for generation of a sustaining voltage to a spark device in timed relation to the ionization voltage. However, such devices have been relatively complex and costly, requiring an additional capacitor coupled to the secondary of the transformer. In this regard, reference is made to U.S. Pat. No. 3,835,830 to Shepherd.

SUMMARY OF THE INVENTION

The present invention provides an ignition system wherein a varying magnetic flux in accordance with the operation of the cooperating engine is generated and the transformer is made responsive to the varying magnetic flux so that a voltage at least equal to the spark device sustaining voltage is induced in the transformer secondary coil for application to the spark device in timed relation with the ignition voltage.

Specifically, the ignition system includes a charge storage means such as a capacitor, which selectively accumulates a charge. A step-up transformer is provided with the secondary coil adapted for connection to a spark ignition device (e.g., spark plug). The spark device has a characteristic spark ionization voltage and a characteristic spark sustaining voltage associated therewith. The charge storage means is controllably charged and discharged through the transformer primary coil to develop a discharge induced voltage for application to the spark device. The discharge induced voltage provides at least one voltage pulse having a magnitude at least equal to the characteristic spark ionization voltage for a first time period and initiates the ignition spark.

The magnetic flux through the transformer secondary coil is also varied such that a voltage is magnetically induced in the transformer secondary coil in timed relation with the ionizing voltage. The magnetically induced voltage is at least equal to the characteristic sustaining voltage for a second time period so that the ignition spark is sustained at least for the duration of the second period.

In accordance with another aspect of the present invention, the secondary of the transformer includes a sufficient number of windings such that in respect of a discharge cycle wherein the sum of the discharge induced and magnetically induced open circuit voltages in the secondary is greater than the ionization potential, the magnetically induced voltage and effects of the transformer secondary coil inductance offsets subsequent discharge induced voltage pulses, preventing such pulses from extinguishing the spark.

In accordance with another aspect of the present invention, the trigger coil, charging coil, and transformer primary and secondary coils are all wrapped around a common core.

BRIEF DESCRIPTION OF THE DRAWING

A preferred exemplary embodiment of the present invention will hereinafter been described in conjunction with the appended drawing, wherein like numerals denote like elements, and.

DETAILED DESCRIPTION OF A PREFERRED EXEMPLARY EMBODIMENT

Figure 1:
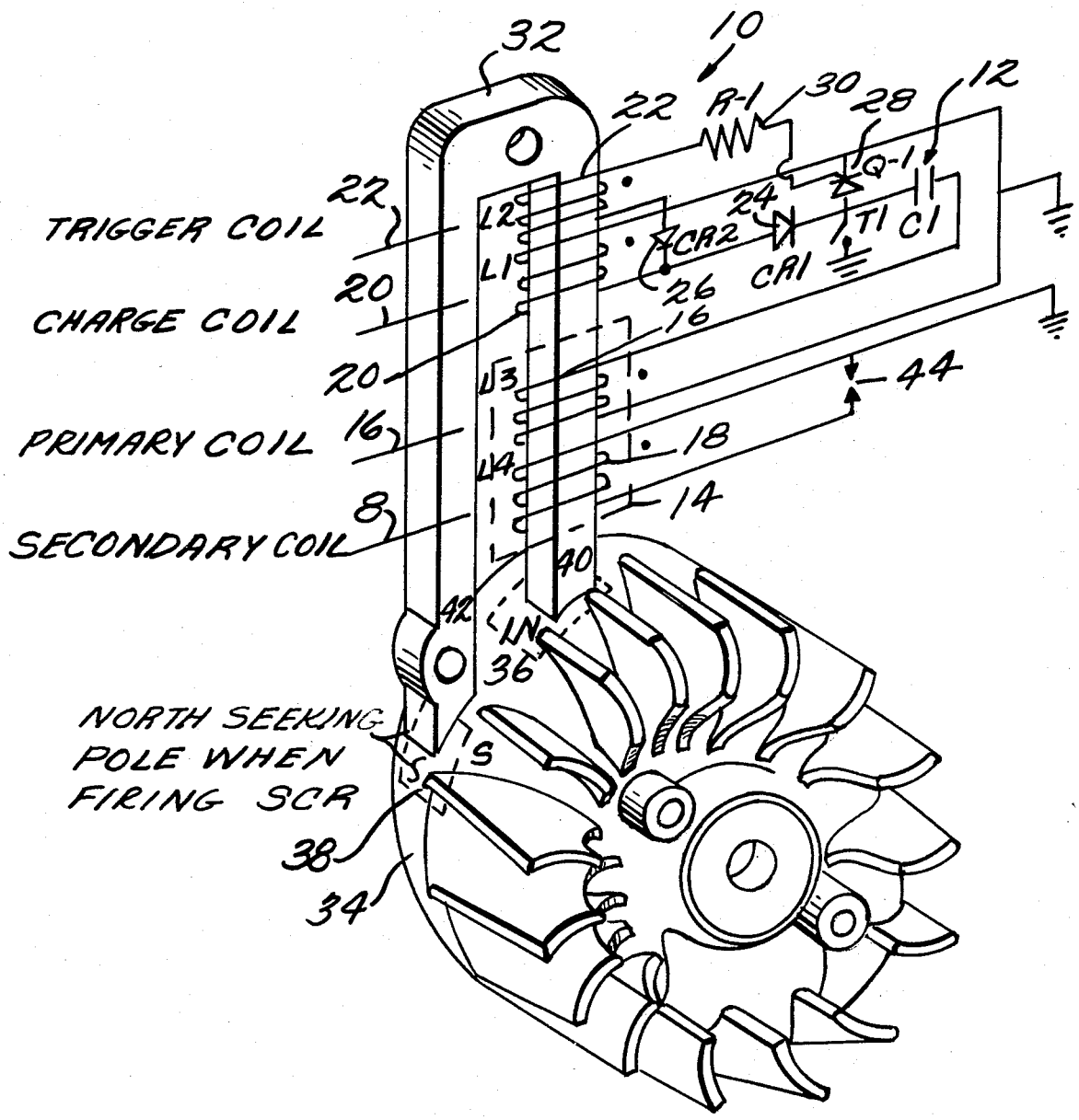
FIG. 1 is a perspective schematic of an ignition system in accordance with the present invention.

Referring now to FIG. 1, an ignition system 10 in accordance with the present invention includes a charge storage capacitor 12, a step-up transformer 14 (including a primary coil 16 and secondary coil 18), a charge coil 20, a trigger coil 22, respective diodes 24 and 26, a silicon-controlled rectifier (SCR) 28, and a gate current resistor 30.

Transformer primary coil 16, transformer secondary coil 18, charge coil 20 and trigger coil 22, are all wound about a common magnetic core 32 disposed to cooperate with a rotor 34.

Rotor 34 is rotated in accordance with engine operation (typically mounted on the engine crankshaft), and is utilized to effect variations in magnetic flux through core 32. Rotor 34 is suitably formed by aluminum die casting with magnetic inserts. Ceramic magnets (not shown) with powdered metal pole shoes 36 and 38, are utilized, disposed at predetermined positions about the periphery of rotor 34. An offsetting counterweight (not shown) of laminated steel or PM composition is also disposed on the periphery of rotor 34.

Core 32 includes respective legs 40 and 42 disposed at distances approximately equal to the predetermined distance between magnets 36 and 38 on rotor 34, and selectively completes a magnetic path through the respective coils. For ease of illustration, core legs 40 and 42, as depicted in FIG. 1, are elongated as compared to an actual embodiment. Similarly, the primary coil 16 and secondary coil 18 of transformer 14, charge coil 20 and trigger coil 22 are shown relatively displaced on core 32. In practice, trigger coil 22 would be wound over charge coil 20, and may use the same wire as the charge coil.

Turning rotor 34 effects relative motion between magnet pole shoes 36 and 38 and core legs 40 and 42, thus varying the magnetic flux through core 32 and the respective coils. The respective coils are wound in such directions as to induce voltages of predetermined polarities in response to changes in magnetic flux through core 32.

In accordance with standard convention, the respective terminals of the coil which provide a positive potential in response to a particular change in flux are designated by a dot. For the purposes of explanation, such terminals will be referred to as the positive terminals of the coils.

The respective components are, of course electrically interconnected. The positive terminal of charge coil 20, the negative terminal of trigger coil 22, the anode of diode 26, the cathode of SCR 28, and the negative terminal of transformer primary coil 16 are each connected to ground potential. The positive terminal of the trigger coil 22 is connected through resistor 30 to the gate of SCR 28. The negative terminal of charge coil 20 is connected to the cathode of diode 26 and to the anode of diode 24. The cathode of diode 24 is connected to the anode of SCR 28 and to one terminal of capacitor 12. The other terminal of capacitor 12 is connected to the positive terminal of primary coil 16.

A conventional spark ionization device 44 is connected across the respective terminals of secondary coil 18. The positive terminal of secondary coil 18 is connected to ground potential.

With reference now to FIGS. 1 through 5, the operation of ignition system 10, in the exemplary case of rotor 34 rotation at 7,000 rpm will be described. For purposes of explanation, an ideal system is assumed (e.g., resistances of inductors ignored) unless otherwise stated.

Figure 2:
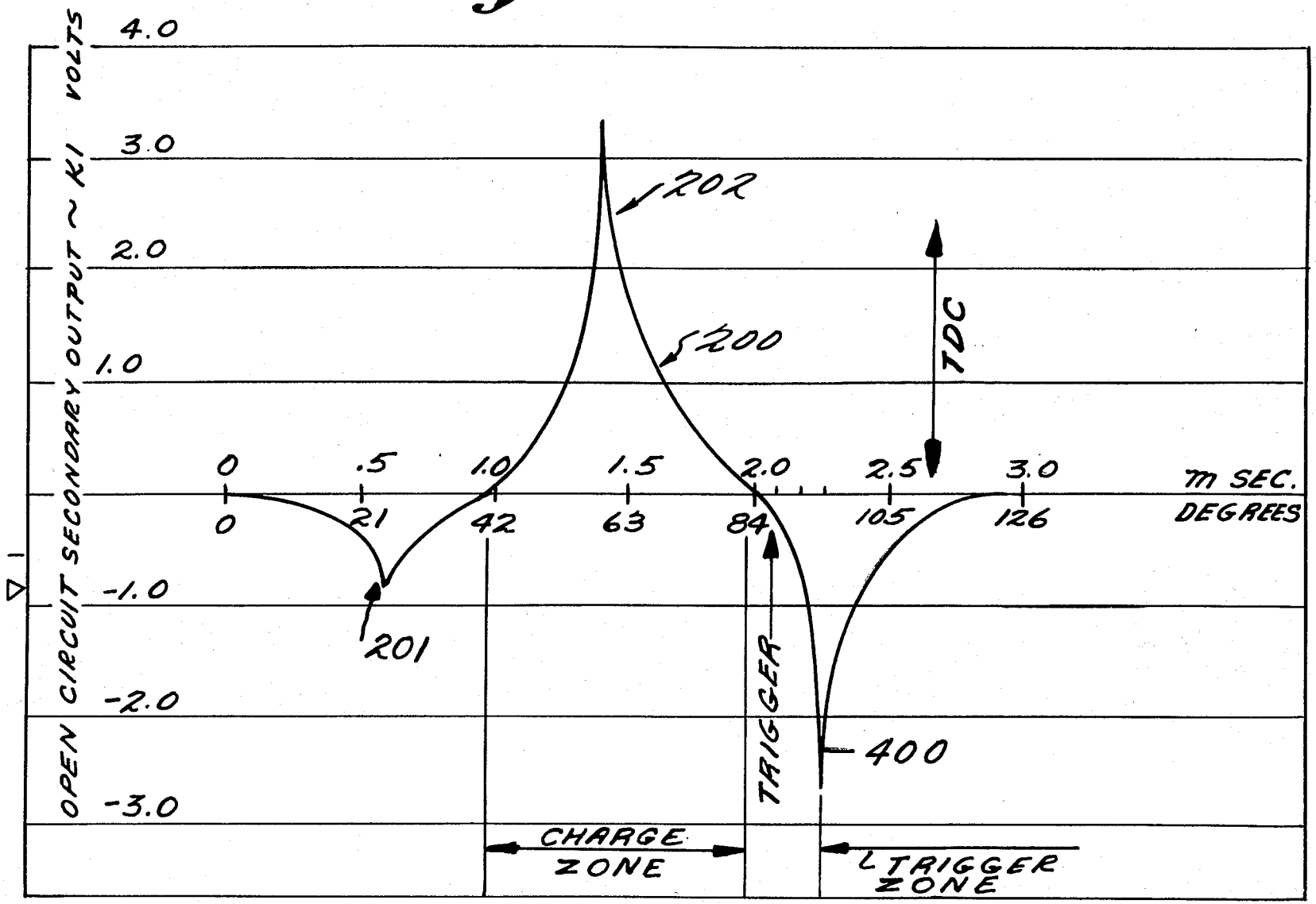
FIG. 2 is a graph of the magnetically induced open circuit voltage across the transformer secondary coil versus time over the course of an engine cycle.

Magnets 36 and 38 are disposed at predetermined positions about the periphery of rotor 34 to effect flux changes in core 32 (and thus induce voltages in the respective coils) at times corresponding to predetermined points in the engine operational cycle. The magnetically induced open circuit output voltage 200 induced in transformer secondary 18 versus rotation of rotor 34 over the course of a cycle (at 7,000 rpm) is shown in FIG. 2. (Effects of capacitive discharge and spark device arcing are not reflected in the graph of magnetically induced open circuit output voltage of FIG. 2.)

Referring now to FIGS. 1 and 2, rotor 34 begins to bring magnet 38 into registry with core leg 40 at approximately 22° (0.5 ms) into the rotor cycle. Accordingly, a change in magnetic flux through core 32 is effected, and respective voltages are induced in coils 16, 18, 20 and 22. However, the respective voltages induced at 22° of the cycle have little, if any, effect on the operation of system 10. The change in magnetic flux is such that the voltages induced in the respective coils provides a positive potential at the respective "positive" terminals of the coils (designated by the dots in FIG. 1). Accordingly, a negative voltage is induced in transformer secondary coil 18, which is applied across spark device 44. Such voltage is generally indicated in FIG. 2 as 201. However, such magnetically induced voltage is of a lower magnitude than the ionization potential, and thus does not initiate a spark. Similarly, a negative potential is applied from charge coil 20 to the anode of diode 24, and a firing signal is provided by trigger coil 20 to the gate of SCR 28. However, diode 24 prevents a negative charging current from being applied to capacitor 12 and, since capacitor 12 is discharged, the triggering pulse to SCR 28 is inconsequential.

The initial significant step in the operational cycle is to charge capacitor 12. At approximately 42° (1.0 ms) of the cycle, rotation of rotor 34 begins to bring magnet 38 into registry with leg 42 of core 32 and magnet 36 into registry with leg 40. A change in flux is thus effected in core 32 which induces respective "negative" voltages in coils 16, 18, 20 and 22 (i.e., negative potentials are induced at the coil terminals designated by dots in FIG. 1). Primary coil 16 completes the capacitor charging circuit and, accordingly, the change in flux is utilized to charge capacitor 12. The polarity of the current associated with negative voltage induced in charge coil 20 effects current flow through diode 24. Accordingly, capacitor 12 accumulates a charge (positive with respect to ground) for the duration of the induced voltage (from approximately 42° (1.0 ms) to 84° (2.0 ms) of the cycle, designated "charge zone" in FIG. 2). The voltage induced in trigger coil 22 is, however, of the improper polarity to trigger SCR 28, and, accordingly, SCR 28 remains in its blocking state. Similarly, a voltage, generally indicated as 202, is induced in transformer secondary coil 18 such that a positive potential is applied across spark device 44. Again, however, since the induced voltage is less than the ionization potential, no spark is initiated.

Thereafter, a trigger pulse for SCR 28 is generated. At approximately 84° (2.0 ms) of the cycle ("trigger zone" in FIG. 2), rotation of rotor 34 begins to bring magnet 36 into registry with core leg 42, to again vary the flux in core 32, and induce positive voltages in coils 16, 18, 20 and 22 (i.e., positive potentials are provided at the terminals designated by dots in FIG. 1). Diode 24 is reverse biased by the induced voltage and prevents a discharge of capacitor 12 through charge coil 20. The voltage produced by trigger coil 22, however, is now of proper polarity to fire SCR 28. Accordingly, a discharge path for capacitor 12 is provided through SCR 28 and primary coil 16.

Figure 3:
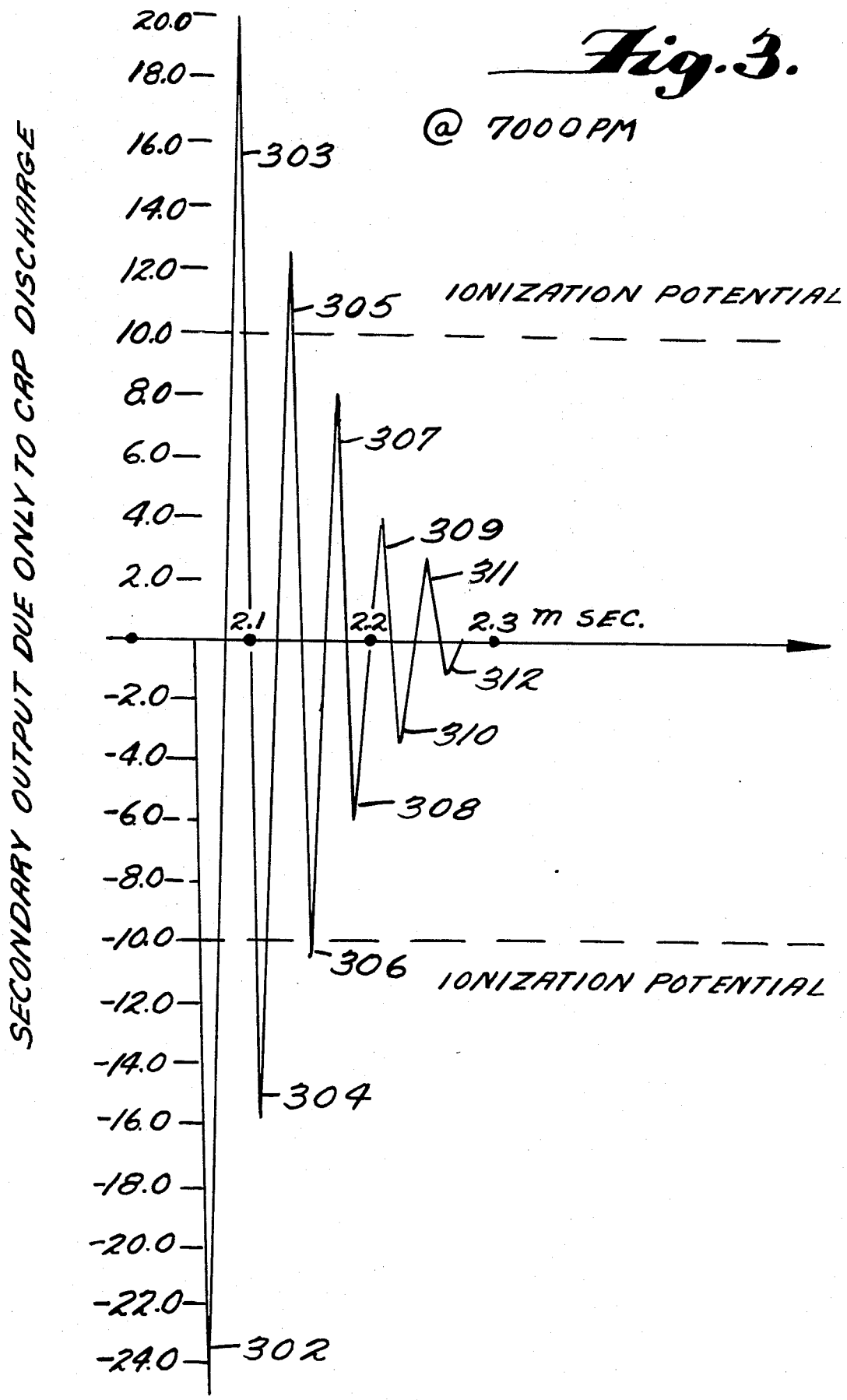
FIG. 3 is a graph of the discharge induced open circuit voltage across the secondary coil of the transformer versus time (on an expanded timescale as compared to FIG. 2)

When SCR 28 is triggered, a damped oscillatory discharge of capacitor 12 through transformer primary coil 16 is initiated, inducing a high voltage signal in secondary coil 18. The open circuit discharge induced voltage 300 in secondary coil 18 is shown in FIG. 3 on a greatly expanded timescale as compared to FIG. 2. (Effects of other induced voltages and spark device arcing are not reflected in FIG. 3.) Referring now to FIGS. 1 and 3, when SCR 28 is initially rendered conductive, current flows from capacitor 12 through SCR 28 into the negative terminal of primary coil 16, then from the positive terminal of primary coil 16 back to capacitor 12. The current flow through primary coil 16 induces a negative open circuit voltage 302 (on the order of −24 Kv) across secondary coil 18. Such current flows until capacitor 12 accumulates sufficient magnitude of charge with the opposite polarity (i.e., negative with respect to ground) to reverse bias and render non-conductive SCR 28. However, a discharge path through primary coil 16 for a negative polarity current is provided by diodes 26 and 24. Current thus flows from capacitor 12 into the positive terminal of primary coil 16, through diodes 26 and 24, to capacitor 12. Such current flow continues until capacitor 12 accumulates sufficient charge of the initial polarity to reverse bias diodes 24 and 26. Such negative current flow through primary coil 16 induces a positive open circuit voltage 303 (on the order of 20 Kv) across secondary coil 18. When capacitor 12 again accumulates a positive charge, SCR 28 is properly biased for conduction. It is noted that the time constant of the discharge cycle is exceedingly low in view of the relatively low resistance in the discharge circuit, and is orders of magnitude faster than the time frame of the magnetic flux change due to the rotation of rotor 34 (i.e., the trigger zone depicted in FIG. 2). Accordingly, the trigger pulse induced in trigger coil 22 is still present at the gate of SCR 28. Thus, SCR 28 is again rendered conductive upon being forward biased by capacitor 12. The cycle is thus repeated, resulting in generation of successive pulses 304–312 in secondary coil 18. Accordingly, an oscillatory voltage is established through primary coil 16, which in turn induces an oscillatory voltage in transformer secondary coil 18. However, due to losses in the circuit, e.g., the resistance of primary coil 16, capacitor 12 does not charge to the same level in successive cycles, and the oscillatory voltage is heavily damped. The damped oscillatory voltage 300 induced in transformer secondary coil 18 by the discharge of capacitor 12 will hereinafter be referred to as the "discharge induced voltage" 300.

In the absence of any other induced or extrinsic voltage in secondary coil 18, damped oscillatory voltage 300 would result solely in a plurality of individual sparks. As is shown in FIG. 3, the high secondary-to-primary turns ratio of transformer 14 establishes an induced open circuit voltage that is initially substantially higher in magnitude (e.g., 24 Kv) than the characteristic ionization potential (10K) of spark device 44. However, the peak magnitude of each successive cycle decreases until ultimately (e.g., after fifth pulse 306) falling below the ionization potential level, rendering the signal incapable of initiating a spark. Thus, successive sparks would be generated for each pulse of the oscillatory voltage having a peak magnitude above the ionization potential, e.g., a separate spark would be generated for each of pulses 302–306. The spark would be initiated when the magnitude of the voltage rose in excess of the ionization potential (10K) and would thereafter be extinguished when the potential difference dropped below the sustaining potential (500 V). Absent other factors, the result is thus 5 separate spikes (short duration sparks) occurring over a time span of approximately 0.1 ms.

Figure 4:
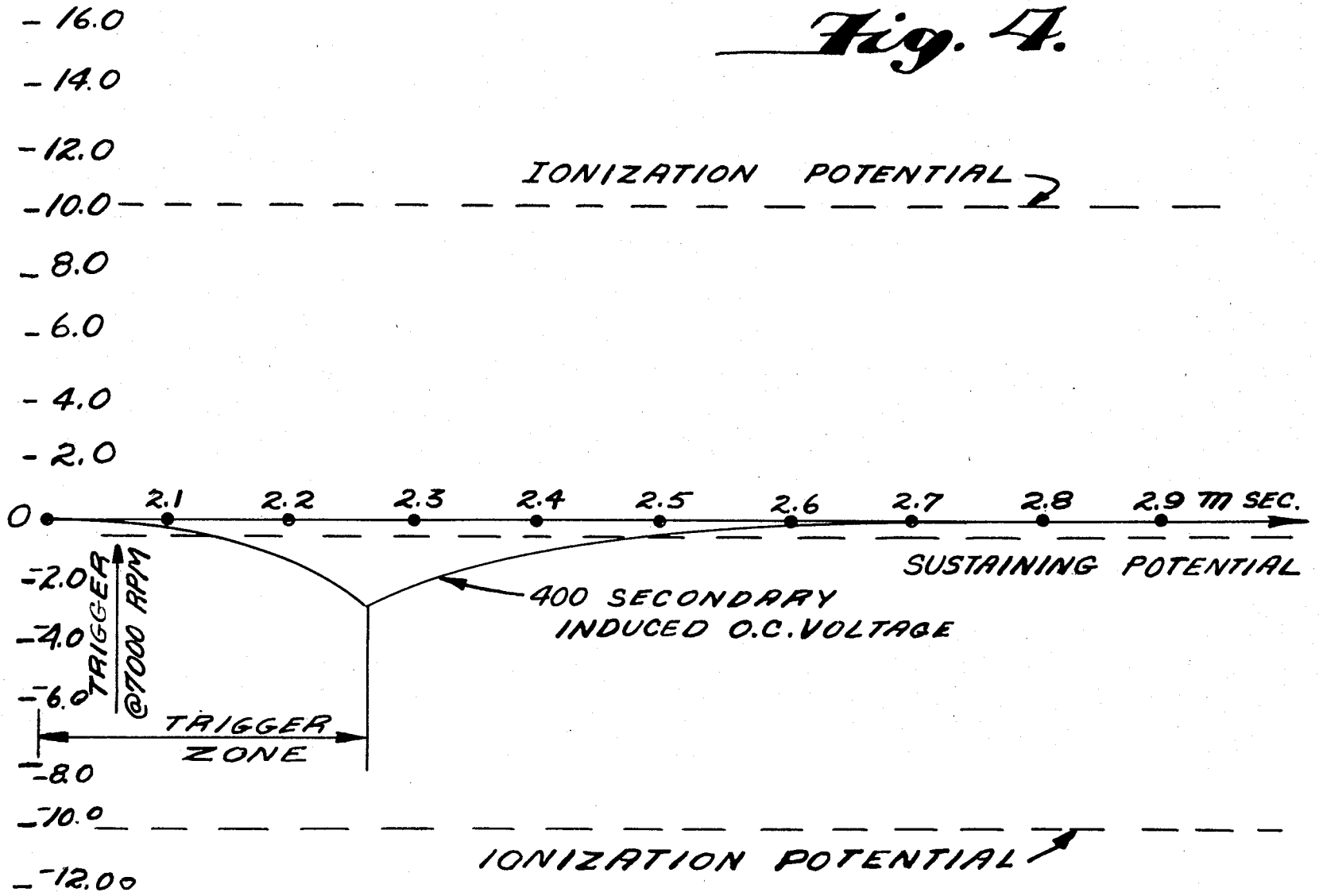
FIG. 4 is a graph of the magnetically induced open circuit voltage across the transformer secondary coil versus time (on the timescale of FIG. 3)

However, in accordance with the present invention, the changing magnetic flux through core 32 induces an additional voltage in secondary coil 18, as shown in FIG. 4. The magnetically induced voltage 400 (for the case of 7,000 rpm) occurring in response to magnets 36 cooperating with core leg 42 (e.g., approximately 2.0 ms), is shown in FIG. 4, on approximately the same expanded timescale as discharged induced voltage 300 in FIG. 3. In the exemplary case of 7,000 rpm rotor speed, and trigger zone beginning at 2.0 ms (see FIG. 2), magnetically induced pulse 400 begins concurrently with the trigger zone, rising to a maximum amplitude (approximately −2.5 Kv) at the end of the trigger zone, and thereafter gradually decaying in amplitude. As seen from FIG. 4, the magnitude of magnetically induced pulse 400 initially exceeds the sustaining potential (500 V) at approximately 2.15 ms (during the trigger period) and continues to exceed the sustaining potential until approximately 2.45 ms into the cycle. Thus, a voltage pulse which exceeds the sustaining voltage for a relatively long period (e.g., 0.3 ms), as compared to the capacitive discharge induced pulses (e.g., 0.02 ms), is provided in timed relation (e.g., concurrently) with the discharged induced pulses.

Figure 5:
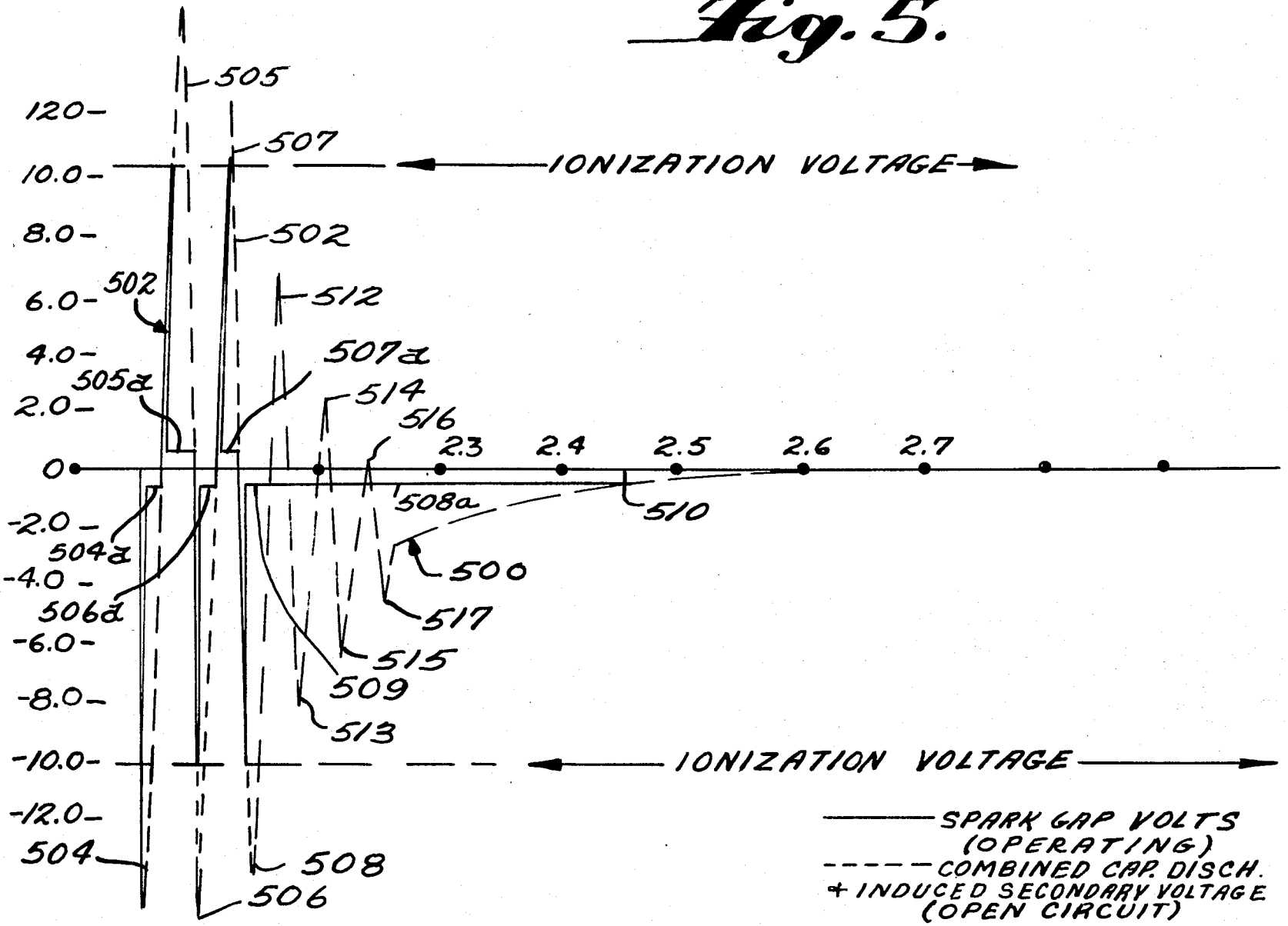
FIG. 5 is a graph of the composite (combined) open circuit voltage across the secondary versus time (timescale of FIG. 3) and of the gap operating voltage versus time.

The effective open circuit potential across transformer secondary coil 18 is the algebraic sum of the discharge induced voltage 300 and magnetically induced voltage 400. A composite open circuit voltage 500 is illustrated in FIG. 5. In the preferred embodiment, magnetically induced open circuit voltage 300 tends to be additive to the negative pulses of the discharge induced voltage 400 and subtractive from the positive pulses.

Composite open circuit voltage 500 is in the general form of a negatively offset damped oscillation, including respective oscillatory pulses 50–516 and an extended pulse 517. Pulses 504, 506 and 508 and pulses 505 and 507 exceed the negative polarity and positive polarity ionization potentials, respectively. Extended pulse 517 gradually decays from a peak negative voltage of approximately −4.0 Kv, at approximately 2.75 ms to −500 V at approximately 2.45 ms and thereafter to zero. The composite open circuit voltage 500, however, does not reflect the arcing operation of spark device 44 (FIG. 1). In operation, the voltage across the spark gap (i.e., the spark gap operating voltage 502, also depicted in FIG. 5) reflects such conduction (arcing) by the spark device. When spark device 44 is non-conductive (not arcing), device 44 presents an open circuit (i.e., essentially infinite impedance) to transformer secondary coil 18. Thus, the transformer open circuit voltage is initially applied across spark device 44. However, when the voltage across spark device 44 reaches the characteristic ionization potential (e.g., 10 Kv), an arc is initiated, effectively completing a circuit with secondary coil 18. When the spark is initiated, voltage across the spark gap immediately assumes the value of the sustaining voltage (e.g., 500 V). The spark gap voltage remains at the sustaining voltage until the current in the circuit drops below a level capable of supporting the sustaining voltage across the spark gap, at which point the spark is extinguished and the spark device rendered non-conductive. The spark device remains non-conductive until the transformer open circuit potential again reaches the ionization potential.

In accordance with the present invention, CDI System 10 generates a sustained spark of relatively long duration. The sustained spark may, however, as in the example of FIG. 5, be preceded by a predetermined number of separate relatively short duration sparks. Respective separate short duration sparks (corresponding to waveform portions **504*a*–507*a*, and hereinafter referred to as sparks 504*a*–507*a*) are generated in response to open circuit voltage pulses 504–507. However, a sustained spark of relatively long duration (corresponding to waveform portion 508*a*, and hereinafter referred to as sustained spark 508*a*) is initiated when pulse 508 exceeds the ionization potential. Thereafter, beginning at approximately 2.15 ms (point 509), the spark gap operating voltage 502 is maintained at the sustaining potential (thus sustaining spark 508*a*), irrespective of discharge induced oscillations in the composite open circuit voltage 500, until such time as the composite open circuit voltage 500 drops below the sustaining voltage at approximately 2.45 ms (designated as point 510). Thus, sustained spark 508*a*** is provided from approximately 2.15 ms to 2.45 ms in the cycle, a duration on the order of 0.3 ms.

It is noted that spark **508*a* is sustained notwithstanding the fact that the composite open circuit voltage drops below the sustaining potential during each of pulses 508–516. This is due, it is believed, to the inductive impedance of secondary coil 18. When an arc (spark) across the spark gap completes a current path through secondary coil 18, the inductive impedance of secondary coil 18** becomes a major factor in the circuit operation, tending to resist abrupt changes in current flow.

If a given pulse has a magnitude greater than the ionization potential (and thus initiates a spark), but the next successive pulse does not manifest sufficient energy to overcome effects of inductive impedance before the open circuit voltage again raises to a level above the sustaining potential, the spark will not be extinguished. More specifically, when current flow in the circuit changes, the inductive impedance generates a voltage of a polarity tending to impede the change in the current ($V = L\ di/dt$). Thus, once a spark is initiated, it will not be extinguished unless the sum of the "L di/dt" voltage and the composite open circuit voltage drops below the sustaining potential. Discharge induced pulse 306 (FIG. 3), when combined with magnetically induced voltage 400 (FIG. 4), results in a composite open circuit voltage pulse 508, and spark **508*a* is thus initiated. The next successive discharge induced pulse 307 (FIG. 3), while of a polarity opposite to the extant spark gap voltage (and thus tending to reduce the spark gap voltage) is offset by magnetically induced voltage 400 and the effects of the inductive impedance, to such an extent that the actual voltage across spark gap remains above the sustaining level. Subsequent opposite polarity discharge induced pulses (309, 311) are similarly offset. Spark 508** thus is sustained until such time as the magnetically induced voltage becomes insufficient to support the sustaining potential across the spark gap.

It will be appreciated that the subject invention provides a particularly advantageous capacitive discharge ignition system. A spark manifesting both high energy and long duration is provided by generating a magnetically induced voltage in the transformer secondary. The magnetically induced voltage cooperates with the discharge induced pulses to provide, at least once in each operational cycle, a composite open circuit voltage pulse that exceeds the ionization potential to initiate a spark. However, the magnetically induced voltage, in cooperation with the effects of the transformer secondary inductive impedance, offsets subsequent discharge induced voltage pulses of the opposite polarity, preventing such pulses from extinguishing the spark, and maintains the gap potential above the sustaining potential for an extended period.

CDI System 10, as described herein, provides the fast rise time of a standard CDI system (on the order of 6 ms), and high kilovolt output of a CDI (24 Kv at 7,000 rpm), while at the same time providing a long spark duration and high energy output. Spark durations of on the order of 10 times that of conventional passive discharge ignitions, with energy of on the order of 5 times the conventional CDI systems, are provided.

It will be understood that the above description is of preferred exemplary embodiments of the present invention, and that the invention is not limited to the specific forms shown. Modifications may be made in the design and arrangement of the elements without departing from the spirit of the invention as expressed in the appended claims.

What is claimed is:

1. In an ignition system for an internal combustion engine of the type including means for generating a varying magnetic flux in accordance with the operation of said engine; a step-up transformer having primary and secondary coils, said secondary coil being adapted for coupling to a spark ignition device; and means for selectively generating at least one current pulse through said transformer primary coil in timed relation to operation of said engine to induce an ignition voltage to said spark ignition device; the improvement wherein:

said transformer comprises means responsive to said varying magnetic flux for inducing a sustaining voltage in said transformer secondary coil for application to said spark device in timed relation with said ignition voltage.

2. An ignition system adapted for cooperation with internal combustion engine comprising:

charge storage means responsive to charging signals applied thereto, for accumulating a charge;

a step-up transformer having a primary coil and at least one secondary coil, said secondary coil having a predetermined number of turns and being adapted for connection to a spark ignition device having a characteristic spark ionization voltage and a characteristic spark sustaining voltage associated therewith;

spark initiating means, cooperating with said engine in accordance with the operation of the engine, for controllably charging said charge storage means and discharging said charge storage means through said transformer primary coil, to develop an ionizing voltage for application to said spark ignition device, said ionizing voltage being at least equal to said characteristic spark ionization voltage for a first time period to initiate an ignition spark by said spark ignition device; and spark sustaining means, formed at least in part by the structural relationship between said transformer and a rotor means, cooperating with said engine, for varying magnetic flux through said transformer secondary coil and inducing a sustaining voltage, in said transformer secondary coil in timed relation with said ionizing voltage and having a magnitude at least equal to said characteristic sustaining voltage for a second time period, for application to said spark ignition device, said sustaining means for sustaining said ignition spark at least until the expiration of said second period.

3. An ignition system adapted for cooperation with an internal combustion engine comprising:

charge storage means responsive to charging signals applied thereto, for accumulating a charge;

a step-up transformer having a primary coil and at least one secondary coil, said secondary coil having a predetermined number of turns and being adapted for connection to a spark ignition device having a characteristic spark ionization voltage and a characteristic spark sustaining voltage associated therewith;

spark initiating means, cooperating with said engine in accordance with said engine operation, for controllably charging said charge storage means and discharging said charge storage means through said transformer primary coil, to develop an ionizing voltage for application to said spark ignition device, said ionizing voltage being at least equal to said characteristic spark ionization voltage for a first time period to initiate an ignition spark by said spark ignition device; and spark sustaining means, including means, cooperating with said engine, for varying magnetic flux through said transformer secondary coil and inducing a sustaining voltage in said transformer secondary coil in timed relation with said ionizing voltage and having a magnitude at least equal to said characteristic sustaining voltage for a second time period, for application to said spark ignition device, for sustaining said ignition spark at least until the expiration of said second period, wherein said means for varying magnetic flux comprises a rotor, adapted for rotation by said engine, having oppositely poled magnets disposed at predetermined distances about the periphery thereof, and core means, for selectively completing a magnetic path between said oppositely poled magnets, motion of said magnets generating charges in flux through said path, said transformer secondary coil being wound about said core means and having a sufficient number of turns such that said sustaining voltage is induced in said secondary coil by changes in magnetic flux through said path due to movement of said magnets.

4. The system of claim 2 wherein said spark initiating means comprises:

a charge coil, cooperating with said engine, for selectively charging said charge storage means;

a switch means, responsive to control signals applied thereto, for controllably completing a discharge current path for said charge storage means through said transformer primary coil, and a trigger coil, cooperating with said engine for generating said control signals to said switch means;

said charge coil and trigger coil being responsive to said varying magnetic flux.

5. The system of claim 3 wherein said spark initiating means comprises:

a charge coil, wound about said core means and responsive to said changes in flux, for selectively generating a charging signal to said charge storage means;

switch means, responsive to control signals applied thereto, for controllably completing a discharge current path for said charge storage means through said transformer primary coil;

a trigger coil, wound about said core means and responsive to said changes in flux, for selectively generating said control signals to said switch means.

6. The system of claim 5 wherein:

said charge storage means comprises a capacitor, said switching means comprises a silicon-controlled rectifier (SCR) having an anode, a cathode, and a gate; and said system further comprises first and second diodes, each having an anode and a cathode, and a resistance;

a first polarity terminal of said charge coil being connected to the anode of said first diode, and to the cathode of said second diode, the cathode of said first diode being coupled to one terminal of said capacitor, and the anode of said SCR;

the second terminal of said capacitor being connected to the second polarity terminal of said transformer primary;

the second polarity terminal of said charge coil, the first polarity terminal of said trigger coil and the cathode of said SCR being connected to the first polarity of said transformer primary coil.

7. The system of claim 2 wherein said second period is longer than said first period.

8. The system of claim 2 wherein said second time period is initiated prior to the end of said first period.

9. An ignition system comprising:

a step-up transformer having primary and secondary coils, said secondary coil showing an inductive impedance associated therewith and being adapted for connection to a sparking device;

means for selectively generating a damped oscillatory signal through said transformer primary coil tending to induce relatively short duration pulses in said secondary coil; and means, including means for generating a controllably changing magnetic flux through said secondary coil to magnetically induce a signal in said secondary coil in timed relation with said oscillatory signal, having a magnitude in excess of a predetermined sustaining level associated with said spark device for a relatively long time period, for providing, in response to said oscillatory signal, at least one high voltage pulse sufficient to initiate a spark by said spark device, and sustain such spark so long as said magnetically induced signal is of a magnitude at least equal to said sustaining level.

10. An ignition system adapted for cooperation with an internal combustion engine, comprising:

a rotor adapted for rotation by said engine, having oppositely poled magnets disposed thereon at predetermined positions;

a magnetic core, cooperating with said rotor, for selectively completing a magnetic path between said oppositely poled magnets, motion of said magnets effecting charges in the magnetic flux through said path in accordance with operation of said engine;

charge storage means, responsive to charging signals applied thereto, for accumulating a charge;

a charging coil, wrapped around said core and responsive to changes in magnetic flux through said path, for generating said charging signals to said charge storage means;

a step-up transformer, having primary and secondary coils, each wrapped around said core and responsive to changes in magnetic flux in said path;

said secondary coil being adapted for connection to a spark ignition device and including sufficient turns to induce a sustaining voltage to said spark ignition device in response to said changes in magnetic flux over the operative range of said engine operation;

switch means, responsive to control signals applied thereto, for controllably completing a discharge path for said charge storage means through said transformer primary coil; and a trigger coil, wrapped around said core and responsive to changes in magnetic flux through said path, for generating said control signals to said switch means, completion of said discharge path inducing ionization of a spark by said spark ignition device and changes in magnetic flux in said path inducing sustaining of said spark.

* * * * *